US008968164B2

(12) United States Patent
Giannelli

(10) Patent No.: US 8,968,164 B2
(45) Date of Patent: Mar. 3, 2015

(54) EXERCISE APPARATUS AND METHOD WITH SLIDING HANDLE ASSEMBLY

(75) Inventor: Raymond Giannelli, Franklin, MA (US)

(73) Assignee: Cybex International, Inc., Medway, MA (US)

( * ) Notice: Subject to any disclaimer, the term of this patent is extended or adjusted under 35 U.S.C. 154(b) by 163 days.

(21) Appl. No.: 13/537,655

(22) Filed: Jun. 29, 2012

(65) Prior Publication Data

US 2014/0005009 A1 Jan. 2, 2014

(51) Int. Cl.
*A63B 21/062* (2006.01)
*A63B 21/00* (2006.01)

(52) U.S. Cl.
USPC ..... 482/102; 482/138

(58) Field of Classification Search
CPC ..... A63B 21/00; A63B 21/00058; A63B 21/00065; A63B 21/0079; A63B 21/00112; A63B 21/00116; A63B 21/00127; A63B 21/14; A63B 21/1488; A63B 21/1492; A63B 21/1496
USPC ..... 482/92–94, 98–103, 133, 135–139
See application file for complete search history.

(56) References Cited

U.S. PATENT DOCUMENTS 4,154,441 A * 5/1979 Gajda ..... 482/102
4,402,504 A * 9/1983 Christian ..... 482/103
4,603,855 A * 8/1986 Sebelle ..... 482/103
4,632,388 A 12/1986 Schleffendorf
4,640,268 A * 2/1987 Roberts ..... 601/24
5,102,122 A * 4/1992 Piane et al. ..... 482/133
6,165,110 A * 12/2000 Gajda ..... 482/102
6,217,493 B1 * 4/2001 Spletzer ..... 482/103
6,394,935 B1 * 5/2002 Lake ..... 482/94
6,685,600 B1 * 2/2004 Ullman ..... 482/103
6,770,015 B2 * 8/2004 Simonson ..... 482/99
7,335,141 B2 * 2/2008 Piane, Jr. ..... 482/99
7,503,882 B2 * 3/2009 Sechrest et al. ..... 482/103
8,070,658 B2 12/2011 Giannelli et al.
8,246,524 B2 * 8/2012 Castillo ..... 482/92
2004/0018920 A1 * 1/2004 Simonson ..... 482/99
2007/0042878 A1 * 2/2007 Lundquist et al. ..... 482/99
2008/0242520 A1 * 10/2008 Hubbard ..... 482/98
2008/0300116 A1 * 12/2008 Eder ..... 482/100
2011/0230315 A1 * 9/2011 Castillo ..... 482/94
2013/0065737 A1 * 3/2013 Habing ..... 482/102
2013/0303346 A1 * 11/2013 Barker ..... 482/129
2013/0337982 A1 * 12/2013 Williams ..... 482/122

* cited by examiner

*Primary Examiner* — Stephen Crow
*Assistant Examiner* — Garrett Atkinson
(74) *Attorney, Agent, or Firm* — Novak Druce Connolly Bove + Quigg LLP

(57) ABSTRACT

Exercise apparatus and method including a slidable handle assembly. In one embodiment, a support arm structure, pivotally mounted on an upright frame, enables alternatively fixed positioning of a rod at various vertical distances above a ground plane, in a generally horizontal orientation. A pair of left and right handle bracket assemblies are sildably mounted on the rod, and can be engaged by a user for moving the slidable handle bracket assembly across the rod while overcoming a resistance established by an adjustable resistance mechanism (e.g., weight stack). In one embodiment, the apparatus and method are used for developing muscles used during trunk rotation of a user in a standing position.

22 Claims, 12 Drawing Sheets

EXERCISE APPARATUS AND METHOD WITH SLIDING HANDLE ASSEMBLY

FIELD OF THE INVENTION

The present invention relates to an exercise apparatus and method with a slidable handle assembly, the apparatus and method being useful, in one example, for developing the muscles used during trunk rotation of a user in a standing position.

BACKGROUND

Physical exercise apparati have been designed in the past which enable a user to perform a variety of different exercises. A user, typically standing or sitting in front of the machine, pulls or pushes against various resistance mechanisms, such as a resistance cable attached to a weight stack. One particular exercise motion that is used in basically in every sport is known as trunk rotation, and comprises a combination of a hip rotation and a spinal rotation. For example, when a user swings a golf club or a baseball bat, or throws a football or a punch, a trunk rotation motion is required. Thus, it would be desirable to provide an exercise apparatus that develops the muscles utilized during such motion.

SUMMARY OF THE INVENTION

An apparatus and method are provided in accordance with the present invention in which a pair of opposing pulleys are slidably mounted over an elongated rod. The pulleys are interconnected by a pull cable having a hand grip at each end wherein a user grasps a respective one of the hand grips causing the associated pulley to slide along a length of the rod toward the opposing pulley, thus maintaining the moving pulley in substantial alignment with the longitudinal axis of the elongated rod. In this manner, a substantially upright (e.g., standing or kneeling) user grasping one hand grip and moving it away from the longitudinal axis of the elongated rod (e.g., across his upper torso while twisting his upper torso) can develop the muscles utilized during trunk rotation while maintaining a substantially constant torque about the user's spine during the exercise. This avoids the problems of the prior art apparatus and methods in which a pull cable may wrap around the user's trunk, which causes a significant reduction in torque around the spine.

In accordance with one embodiment of the invention, an exercise apparatus is provided comprising:

- an elongated rod mounted on a frame, the rod having a longitudinal axis and first and second ends;
- a pair of pulleys each mounted on an associated sleeve that is slidably mounted on the elongated rod;
- each of the pulleys being interconnected to a force resistance mechanism and adapted to be held in a stable rest position at respective ones of the first and second ends of the elongated rod;
- the pulleys each comprising a respective pulley wheel, the pulleys being interconnected by a pull cable having opposing ends wound around and interconnecting the pulley wheels;
- each end of the pull cable being interconnected to an associated hand grip;
- the interconnection between the pulleys and the force resistance mechanism being arranged such that when the user grasps a selected one of the hand grips and moves the hand grip away from the longitudinal axis, the pulley associated with the selected hand grip is slidable along the longitudinal axis of the elongated rod under forcible resistance from the force resistance mechanism.

In one embodiment, wherein the ends of the elongated rod are adjustably mounted to the frame such that the longitudinal axis is adjustable to one of a plurality of fixed vertical positions of selectively variable height relative to a ground surface on which a user is disposed for performing an exercise.

In one embodiment, the pulleys are interconnected to the force resistance mechanism via a connector cable.

In one embodiment, the connector cable is interconnected to each of the sleeves on which the pulleys are mounted.

In one embodiment, the rod is adjustably mounted to the frame via a frame member that pivots with respect to the frame.

In one embodiment, the elongated rod is mounted to the frame such that the rod is stationary against rotation transverse to its longitudinal axis.

In one embodiment, the elongated rod is mounted to the frame such that the longitudinal axis of the rod is disposed generally parallel to the ground surface at all fixed vertical positions of the rod.

In accordance with another embodiment of the invention, a method of performing a muscle exercise comprises providing an exercise apparatus comprised of a frame stationary with respect to a ground surface on which a user is disposed for performing an exercise, an elongated rod mounted on the frame having a longitudinal axis and first and second ends, a pair of pulleys each mounted on an associated sleeve that is slidably mounted on the elongated rod, wherein each of the pulleys is interconnected to a force resistance mechanism and wherein the pulleys are interconnected by a pull cable having opposing ends each interconnected to an associated hand grip engageable by the user, the method further comprising:

- the user grasping a selected one of the hand grips and moving the selected grip away from the longitudinal axis of the rod with a degree of force sufficient to overcome the force resistance mechanism such that the pulley and sleeve associated with the selected hand grip slides along the longitudinal axis of the elongated rod.

In accordance with another embodiment of the invention, an exercise apparatus is provided comprising:

- an elongated rod mounted on a frame, the rod having a longitudinal axis and first and second ends;
- a pair of pulleys each mounted on an associated sleeve that is slidably mounted on the elongated rod;
- each of the pulleys being interconnected to a force resistance mechanism and adapted to be held in a stable rest position at respective ones of the first and second ends of the elongated rod;
- the pulleys each comprising a respective pulley wheel, the pulleys being interconnected by a pull cable having opposing ends wound around and interconnecting the pulley wheels;
- each end of the pull cable being interconnected to an associated hand grip;
- the interconnection between the pulleys and the force resistance mechanism being arranged such that when the user grasps a selected one of the hand grips and moves the hand grip away from the longitudinal axis, the pulley associated with the selected hand grip is slidable along the longitudinal axis of the elongated rod under forcible resistance from the force resistance mechanism; and
- the rod being mounted on the frame such that the longitudinal axis of the rod is disposed in a generally horizontal orientation.

In one embodiment, the rod is adjustably mounted to the frame on a pivot arm structure, wherein the arm structure rotates with respect to the frame for adjusting the height of the rod above a ground surface on which a user is disposed.

In one embodiment, the apparatus includes a pivot adjustment mechanism including a support plate mounted on the frame with a plurality of apertures disposed in a circumferential array for adjusting the rotable position of the arm structure with respect to the frame.

In one embodiment, the sleeves are each interconnected to the force resistance mechanism via a connector cable and the connector cable engages one or more pulley wheels mounted to the pivot arm structure.

In one embodiment, the connector cable is assembled together with the sleeve for free rotation independent of the sleeve around the elongated rod.

In one embodiment, the sleeve is mounted for rotation about the longitudinal axis of the rod.

In accordance with another embodiment of the invention, an exercise apparatus is provided comprising:

an elongated rod mounted on a frame having a longitudinal axis;

a pair of pulleys each mounted on an associated sleeve adapted to slide along the elongated rod;

a pull cable having opposing ends wound around and interconnecting the pair of pulleys, each end of the cable being connected to an associated hand grip;

each pulley being slidable together with its associated sleeve along the elongated rod via a user grasping the associated hand grip and moving the hand grip away from the longitudinal axis; and wherein the sleeves are interconnected to a force resistance mechanism holding the sleeves at opposing ends of the elongated rod under a selected resistance force.

In one embodiment, the hand grip is rotatable with respect to its associated sleeve.

In one embodiment, the elongated rod has a longitudinal axis, the rod being mounted on the frame such that the rod is disposed in a generally horizontal orientation.

In one embodiment, the elongated rod is mounted on the frame such that the longitudinal axis is selectively adjustable to one of a plurality of fixed positions of selectively variable vertical distance relative to a ground surface on which the user is supported.

In one embodiment, the sleeves are each interconnected to a force resistance mechanism via a connector cable.

In one embodiment, the force resistance mechanism comprises a plurality of incremental force resistance elements that are selectively engagable by the user with the connector cable.

In one embodiment, each of the sleeves are assembled together with respective collars, the sleeves being mounted together with the respective collars for free rotation around the elongated rod, the collars being interconnected to a respective opposing end of a connector cable, the collars being assembled together with the sleeves for free rotation independent of the sleeves around the elongated rod.

In one embodiment, the connector cable has opposing ends interconnected to respective ones of the sleeves, the connector cable having a portion intermediate the opposing ends engageable with the force resistance mechanism.

DETAILED DESCRIPTION

One embodiment of the apparatus of the present invention will now be described, which is meant to illustrate and not limit the scope of the claimed invention. Other embodiments and variations will be apparent to the skilled person and are intended to be included with the scope of the appending claims.

For ease of description, the left and right side frame elements and left and right side rotatable arm/handle assemblies are generally referred to as sub-elements a (left) and b (right) and are given the same reference number. The apparatus is essentially symmetrical with each of the left and right side frame, rotatable arm/handle assemblies, cable and pulley assemblies being the same. Thus, in some instances the sub-assembly only on one side will be described, it being clear from the drawings and reference numbers that the other side sub-assembly is the mirror image.

Figure 1:
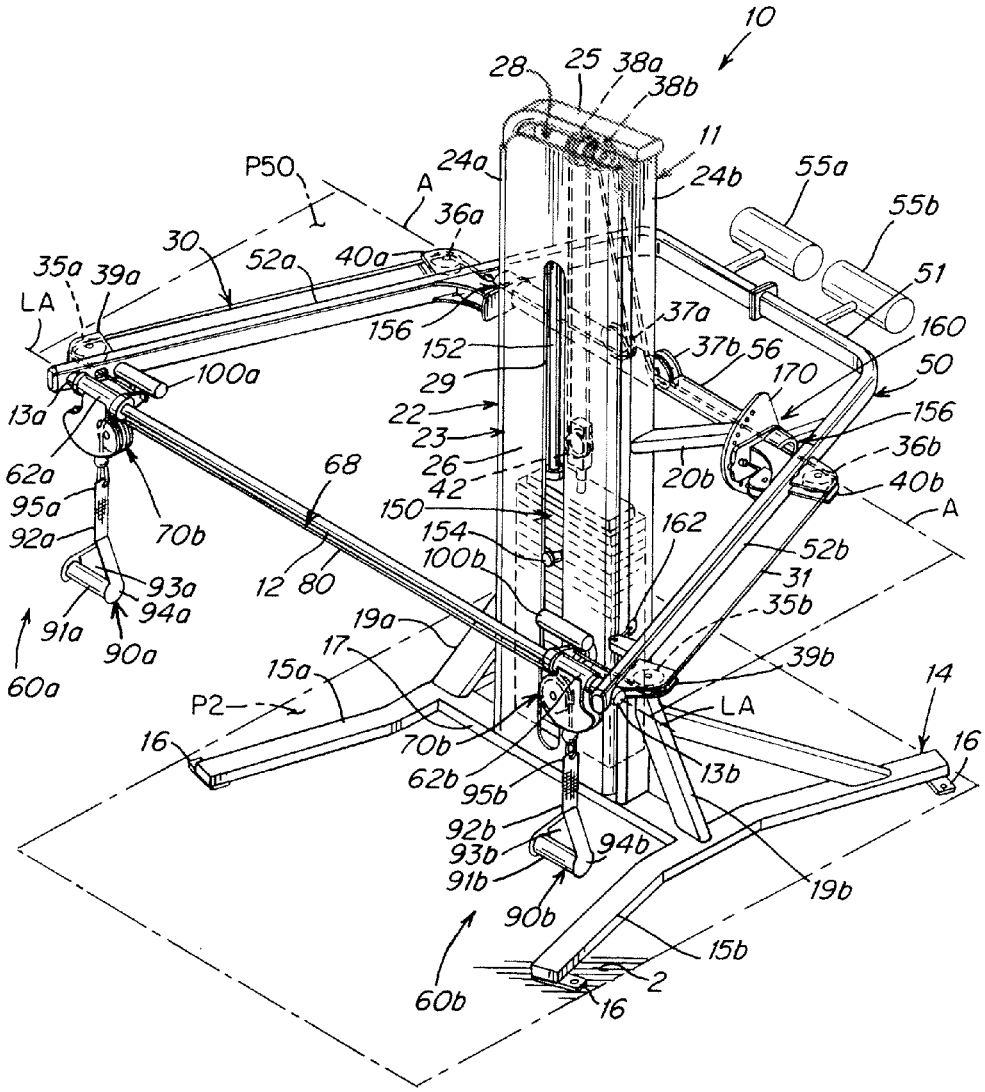
FIG. 1 is a perspective view of one embodiment of an apparatus according to the present invention, including an upright frame, an adjustable support arm structure pivotally mounted on the frame, and a rod attached to the arm structure shown in one of a plurality of fixed horizontal positions with left and right handle bracket assemblies slidably mounted thereon.

FIG. 1 is an overall view of an exercise apparatus 10 according to one embodiment of the invention. The apparatus includes a generally upright frame 11 which rests on a horizontal ground surface 2. The frame includes a lowermost base member 14, a vertical support structure 22 that includes an adjustable weight stack 150, and a C-shaped pivoting arm structure 50 adjustably mounted on the frame 11 for lowering or raising a front horizontal rod 12 extending between the two front ends of the C-shaped arm structure 50. A pair of left and right handle bracket assemblies 60*a*, 60*b* with respective left and right hand grips (e.g., handles) 90*a*, 90*b* are slidably mountable on the rod 12 for engagement by a user. When a user, standing in front of the machine 10, pulls the handle of on one of the handle assemblies, that handle will move (extend) toward the user as the associated handle bracket slides across the rod 12 in the direction of the opposing handle bracket. This sliding motion will be further described in the following detailed description and accompanying figures.

As shown in FIGS. 1-7, the rod 12 comprises an elongated cylindrically shaped rod having a longitudinal axis LA, the rod being mounted on the frame such that the longitudinal axis is disposed generally horizontally relative to the ground surface plane P2 which supports the frame and a user.

The apparatus 10 includes a base member 14 disposed generally parallel and adjacent to the horizontal plane P2 of the ground surface 2. The base 14 includes left and right elongated feet members 15*a*, 15*b*, joined by a cross bar 17. At the ends of each foot are mounting pads 16 with holes for bolting the front and rear ends of the feet to the ground surface 2 to maintain the machine in a stationary position. On top of the central cross bar 17 there is mounted a central vertical column or support 22 including a vertically-disposed housing 23 that encloses a weight stack 150. The housing includes left and right end supports (e.g., hollow tubes) 24*a*, 24*b* that are joined by a top support (e.g. hollow tube) 25, along with a front cover 26 and a rear cover 27 that define a central cavity 28 in which the weight stack resides. An elongated vertical opening 29 in the front cover 26 provides access to an adjustable pin 154 for selecting a number of weights in the stack to be attached to a connector (resistance) cable, thereby adjusting the amount of force required by the user to extend the pull handle assemblies 60*a*, 60*b*.

In the present embodiment, the rod 12 on which the slidable handle bracket assemblies 60*a* and 60*b* are mounted, forms one side of a rectilinear pivot arm structure 50. This is by way of example only, as other mechanically rigid support structures can be used for pivotably mounting the rod 12 to the frame 11. In this embodiment, the arm structure 50 includes left and right side arms 52*a*, 52*b* each joined at their rear ends to opposite ends of a transverse rear arm 51, wherein all three arms and the front rod 12 lie in a single horizontal plane P50 that in FIG. 1, is substantially parallel to the ground surface plane P2. This is referred to herein as the middle or central position, also illustrated (in use) in FIG. 2A. With the pivot arm 50 in the middle position, the front rod 12 is in the same horizontal plane P50 as the arm structure 50, parallel to the ground surface plane, and the rod 12 is disposed roughly three feet above the ground surface plane P2. This central position provides easy access by a user standing in front of the machine 10 and rod 12 for engaging and grasping the handles 90*a*, 90*b* in order to pull on the handle(s) and as a result slide the handle bracket(s) across the rod 12 (as shown in FIG. 2A).

To vary the direction of extension and range of motion of the user, the arm structure 50, including left and right side arms 52*a*, 52*b* and supporting rod 12, can be pivoted about a generally horizontal axis A which is disposed parallel to the ground surface plane P2. Pivoting the arm structure 50 clockwise about the axis A enables the user to raise the front rod 12 upwardly, so that the handle assemblies are now further away from the ground surface 2 (e.g., about five feet above the ground 2) than in the middle position, while still maintaining the rod 12 in a plane substantially parallel to the ground surface plane P2. Alternatively, pivot arm 50 can be pivoted in the opposite direction (counterclockwise), lowering the rod 12 so that the handles are now closer to the ground (see FIG. 2B), and a user 4 disposed in front of the machine now will pull upwardly on the handles. Again, the rod 12 is always maintained in a substantially horizontal plane parallel to the ground surface plane P2, but the distance from the ground surface plane varies depending on the pivoted position of arm structure 50 on frame 11.

Figure 2A:
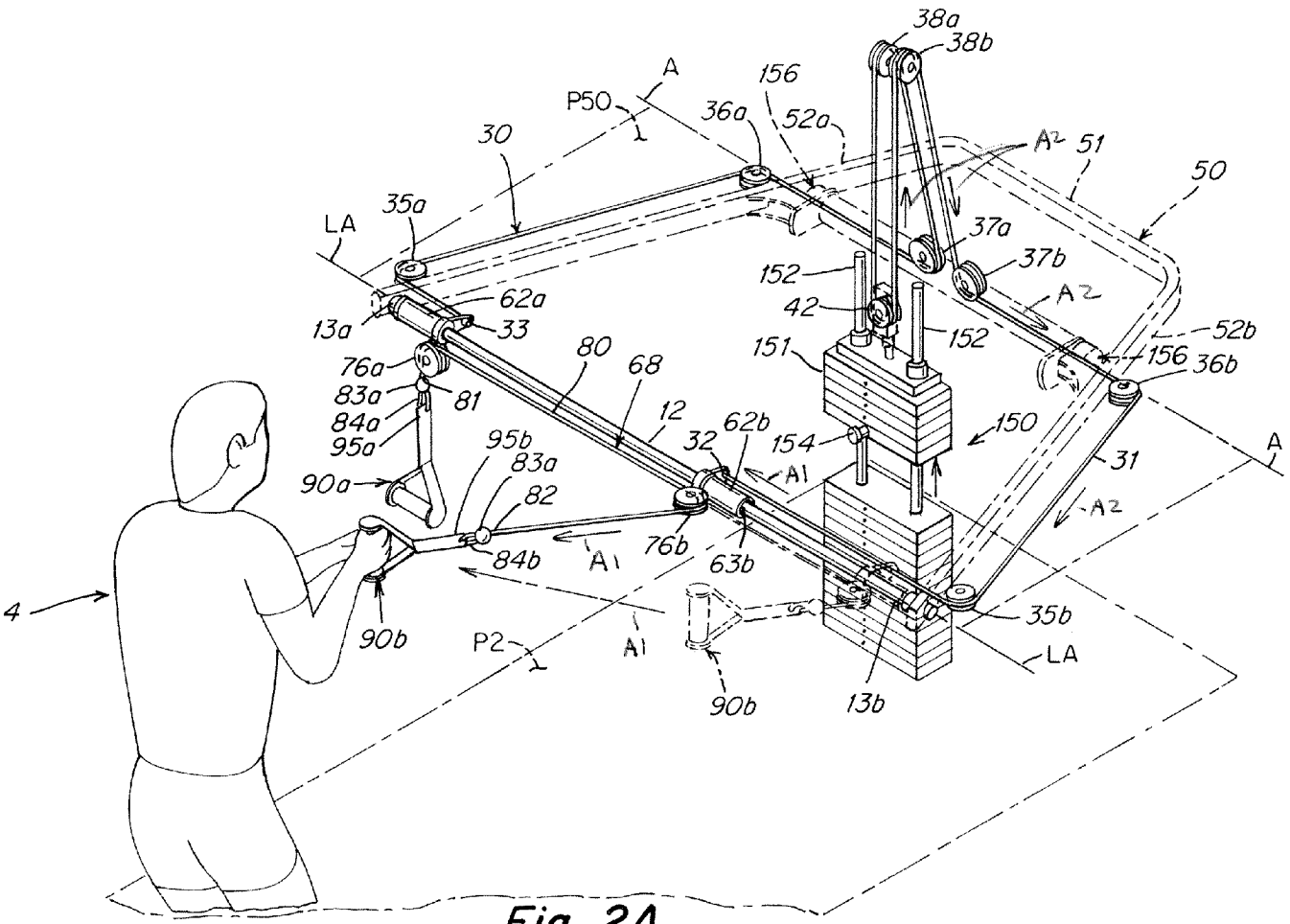
FIG. 2A is a partial schematic perspective view of the pull handle and resistance cable assemblies of the FIG. 1 apparatus, showing a user doing an exercise with the support arm structure and rod in a central horizontal position.

FIG. 2A illustrates the cooperation of multiple pulley cable assemblies during use, including two handle pulley assemblies 70*a*, 70*b* engaging opposite ends of the pull cable assembly 68 and a connector (resistance) cable assembly 30 engaging the weight stack. Relevant portions of these assemblies are shown in FIG. 2A where a user 4 is performing an exercise with the support arms 52*a*, 52*b* in a horizontal middle position (same as FIG. 1). The pull cable assembly 68 is directly engaged by the user; it includes a pull cable 80 having a left end 81 engagable with the left slidable handle bracket 60*a*, and a right cable end 82 engagable with the right slidable handle bracket 60*b*. The left and right handle brackets 60*a*, 60*b* are initially disposed at opposing left and right ends 13*a*, 13*b* of the rod 12 (prior to use, as shown in FIG. 1). When a user grasps the grip 91*b* of right handle 90*b* and pulls it toward himself, as shown by arrows A1 in FIG. 2A, the right handle bracket 60*b* is caused to slide across the rod 12 toward the left handle bracket 60*a*, the latter being fixed in position on the left hand end 13*a* of rod 12 by its engagement with the resistance cable assembly 30 attached to the weight stack 150.

More specifically, the right handle bracket 60*b* includes a slidable sleeve (e.g., tube) 62*b* having a central bore 63*b* which slidably engages the outer cylindrical surface of rod 12. A pulley housing 71*b* attached to slidable tube 62*b* mounts a pulley wheel 76*b*, over which a pull cable 80 can be pulled (by a user) while the wheel rotates. At the right end 82 of pull cable 80, a stop ball 83*b* is provided that prevents the pull cable from being pulled out of the handle bracket 60*b* when the user pulls on the opposing handle 90*a*. The right end 82 of cable 80 is attached by a metal ring 84*b* to a Y-shaped handle frame 92*b*. A grip 91*b* is supported across the open ends 94*b* of the Y-shaped frame 92*b*, wherein an opening 93*b* between the grip and Y-shaped frame allows the user's fingers to be inserted for grasping the grip 91*b*. The opposing end 95*b* of the Y-frame 92*b* has an aperture which receives the ring 84*b* for connecting the stop ball 83*b* between the handle 90*b* and pull cable 80.

The right handle bracket assembly 60*b* further includes a tabbed collar 130*b* attached to the slidable tube 62*b* for connecting the handle bracket 60*b* to the resistance cable assembly 30. More specifically, a first end 32 of resistance cable 31 is attached to the tab portion of the collar 130*b*. The resistance cable 31 extends from collar 130*b* around four right side pulley wheels 35*b*-38*b*, and then around a central pulley 42 which is attached to the weight stack 150. The opposing left end 33 of resistance cable 32 is similarly engaged with the left handle bracket 60*a* and a mirror image pulley assembly with four pulley wheels, and ultimately engages the same central pulley wheel 42 engaged with the same common weight stack 150. Thus, in the present embodiment, a single resistance cable assembly 30 connects the left and right slidable handle brackets 60*a*, 60*b*, while a separate pull cable assembly 68 similarly connects the left and right handle brackets 60*a*, 60*b*, and together the two separate cable assemblies 30 and 68, which each engage the left and right slidable handle brackets 60*a*, 60*b*, enable the resistance training motion and exercises illustrated in the figures.

Returning to FIG. 2A, when a user 4 grasps the right handle 90*b* (shown in phantom lines in its initial position) and pulls the handle 90*b* toward himself while moving away from the machine 10, thereby extending the right handle away from the rod 12, he pulls against the resistance set by the resistance cable assembly 30 which is attached to a select number of weights in the weight stack 150. Here, an adjustable pin 154 selects the upper 5 weights in the stack as a desired resistance level; while the user pulls on the right handle these upper 5 weights rise upwardly along the parallel guide rods 152 of the weight stack. As a result the right handle bracket 62*b* slides to the left on the rod 12, allowing the pull cable 80 to extend further toward the user while the user continues to exert sufficient force to overcome the selected weight resistance 151 (upper 5 weights of the stack). The left handle bracket 60*a* remains stationary with respect to the frame 11, the stop ball 83*a* preventing the pull cable 80 from disengaging with the left handle bracket, and the resistance cable 31 attached to the left handle bracket resisting the force on the pull cable 80 exerted by the user pulling on the right handle. FIG. 2A includes a series of arrows A2 that illustrate the movement of the resistance pull cable 31 around the various pulley wheels, including the right front side wheel 35*b*, right rear side wheel 36*b*, right central lower wheel 37*b*, right central upper wheel 38*b*, and the common wheel 42 attached to the weight stack. In FIG. 2A the rod 12 is in the middle position, parallel to the ground plane P2, and here about 3 feet above the ground surface.

Figure 2B:
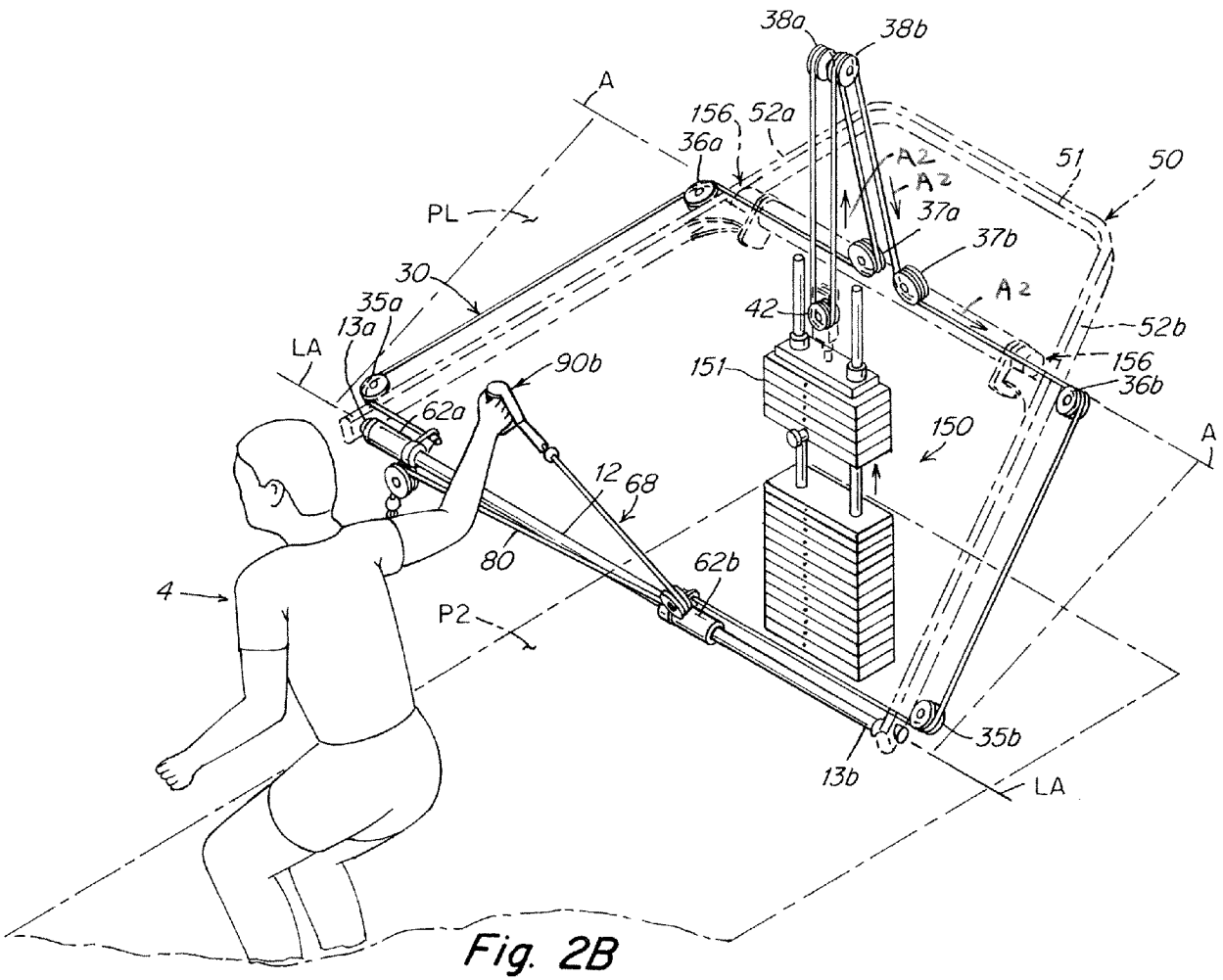
FIG. 2B is a partial schematic perspective view similar to FIG. 2A, showing a user doing an exercise with the support arm structure and rod pivoted to a lowered position.
Figure 4:
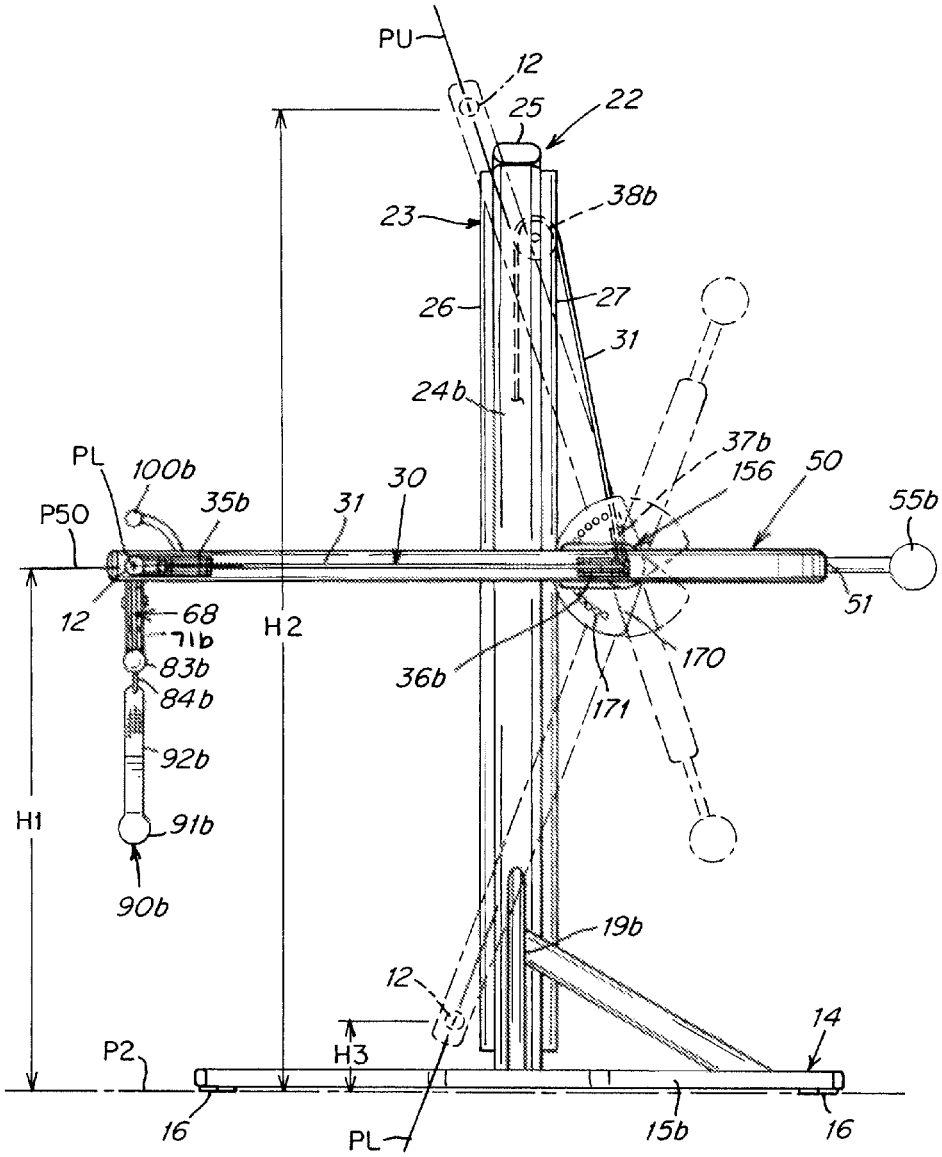
FIG. 4 is a right side elevational view of the apparatus of FIG. 1 showing the support arm structure in a central horizontal position in solid lines, and the arm structure in full vertically up and full vertically down positions in phantom lines.

In contrast, FIG. 2B shows the pivot arm structure 50 rotated counterclockwise about axis A to a lowermost position, wherein the rod 12 is now horizontally aligned in a plane PL much closer to the ground plane 2, here a minimum of about 45 inches above the ground. In this position, the user pulls upwardly on the right handle 90*b*, again overcoming the resistance of the selected weights in the weight stack, similar to FIG. 2A. This adjustability of the height at which the rod 12 is positioned and thus the position at which the handle bracket assemblies are provided, enables a wide range of motion for the user exercising with this single apparatus. FIG. 4 shows in phantom lines a third uppermost position in which the pivot arm structure 50 is pivoted in the opposite direction (clockwise) about axis A, causing the rod 12 to be raised above the middle position, to an uppermost position, in a horizontal plane about five feet above the ground surface. The adjustment mechanism for the pivot arm structure is described below, and may include additional positions between the uppermost and lowermost positions.

FIGS. 3A-3D illustrate the coordinated motion of the pull cable assembly 68 and the resistance cable assembly 30 in use. These figures show a top view of the cable assemblies, with the arm structure 50 supported in the middle horizontal position (same as in FIG. 1).

Figure 3A:
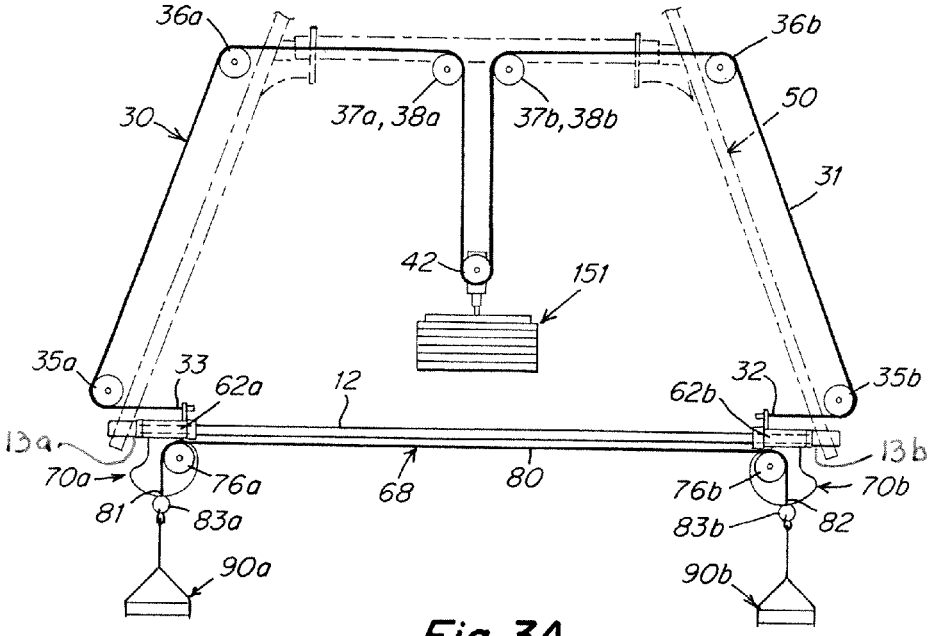
FIG. 3A is a partial schematic view of the pull handle and resistance cable assemblies of FIG. 2, showing the apparatus at rest.

FIG. 3A shows the pull cable 68 and resistance cable 30 assemblies respectively in solid lines, with the support arm structure 50 shown in phantom lines. Here the handles 90*a*, 90*b* are in an initial position, each located at the respective left and right ends 13*a*, 13*b* of the rod 12, respectively. The weight stack is at rest.

Figure 3B:
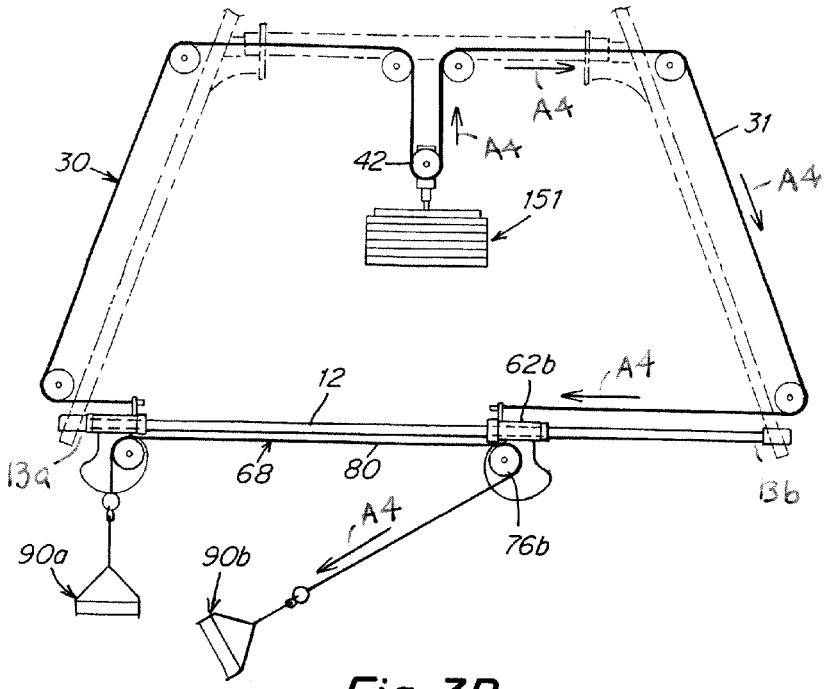
FIG. 3B is a schematic view similar to FIG. 3A showing the apparatus in use with the right hand handle being extended and the active weight stack being raised.

FIG. 3B is similar to FIG. 3A but now shows the right handle 90*b* being extended away from the machine 10, i.e., being pulled by the user (not shown) in a generally leftward direction (arrow A4), causing the right sliding bracket 60*b* to slide toward the left end of 13*a* the rod 12. The arrows A4 illustrate the respective motions of the pull cable 80 and the resistance cable 31 over the respective pulleys.

Figure 3C:
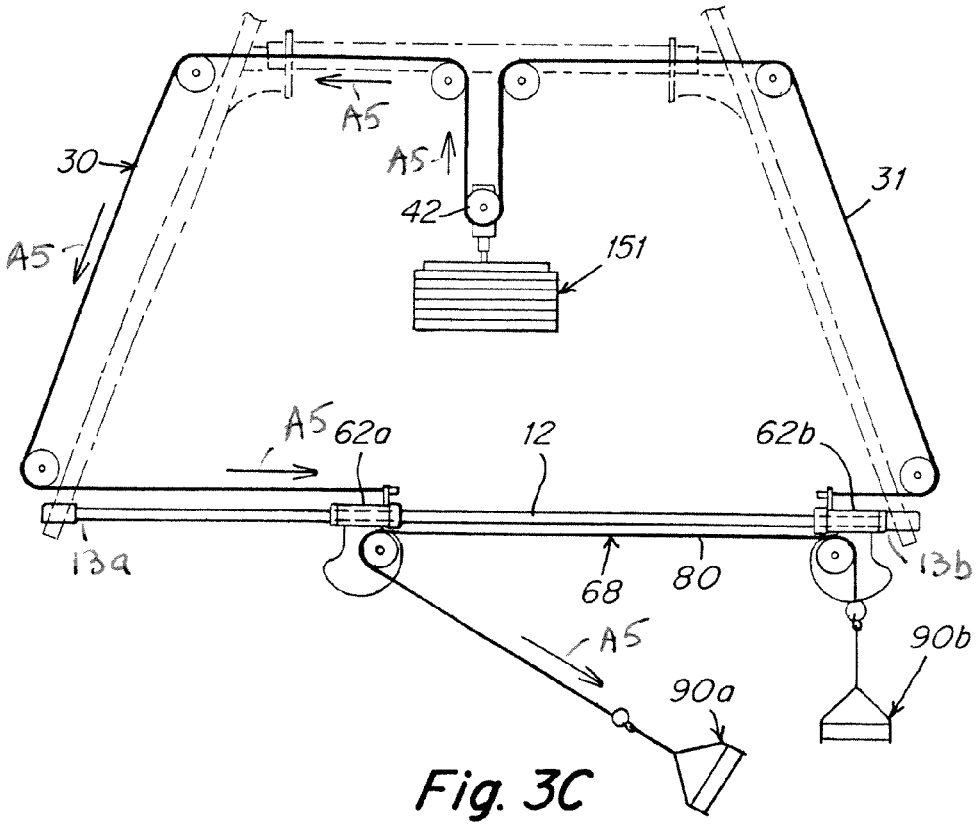
FIG. 3C is a schematic view similar to FIG. 3A showing the apparatus in use with the left hand handle being extended and the active weight stack being raised.

FIG. 3C is a mirror image of FIG. 3B, showing the effect of pulling on the left handle 90*a*, and the respective movements (arrows A5) of the pull cable 80 and resistance cable 31 over the pulleys.

FIG. 4 is a side elevational view of the apparatus of FIG. 1 showing in solid lines the pivot arm structure 50 in the horizontal middle position (in plane P50). FIG. 4 shows in phantom lines the rod 12 in an uppermost position, wherein the handle bracket is disposed near the top end of the vertical frame 11, and in an opposing lowermost position in which the rod 12 is disposed near the lowermost end of the frame (near the base member 14). The base 14 sits generally horizontal and adjacent to the ground plane P2, and the central support column 22 is vertically disposed above the base 14. Trusses 19*a* and 19*b* rigidly support the central support column 22 in an upright vertical position with respect to the base 14. About half-way up the vertical support 22, the pivot arm structure 50 is disposed at a height H1 in the horizontal plane P50. The right pulley housing 71*b* and handle 90*b* are in a relaxed position extending vertically downward, from the plane P50.

Figure 5:
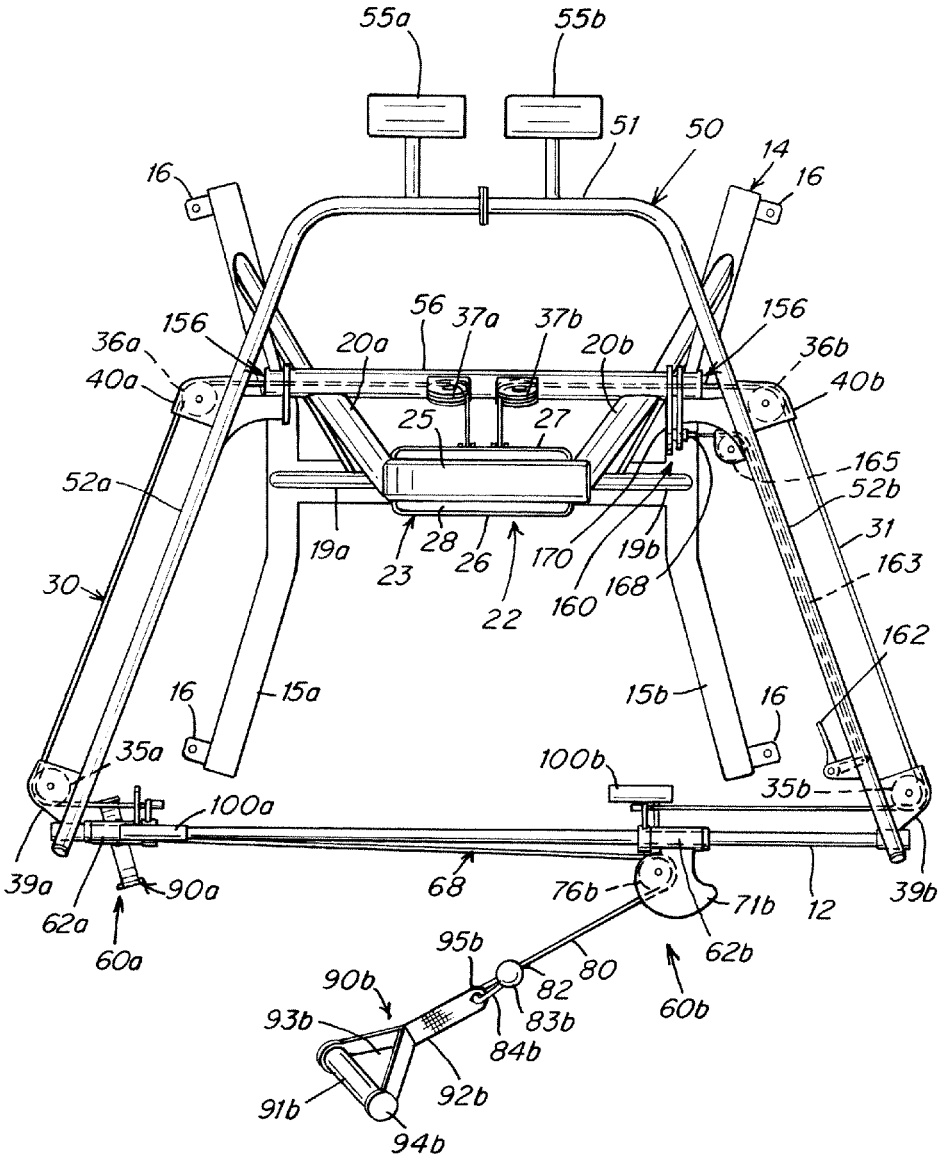
FIG. 5 is a top plan view of the apparatus of FIG. 1 in use with the right hand handle being extended.

The arm structure 50 is pivotally mounted to the upright frame 11 by rotable joints 156 (see FIGS. 1, 4 and 5). A releasable pin 168 is positionable in one of a series of user selectable apertures 171 disposed about the radius of a support plate 170 of the height adjustment assembly 160 for selectively adjusting and positioning the longitudinal axis LA of the rod 12 in any one of a plurality of fixed vertically variable (height) positions relative to a ground surface plane P2. As shown, FIG. 4, the longitudinal axis LA of rod 12 can be selectively fixed at any one of a plurality of different vertical distances or heights including middle H1, uppermost H2 and lowermost H3 positions, relative to the ground plane P2. The rod 12 can be fixed at many other heights (varying vertical distances) above the ground plane P2 depending on the predetermined number and location of fixing apertures 171 provided on the pivot or height adjustment assembly 160. The apertures define the multiple pivotable positions of the support arm structure 50 on the upright frame 11.

FIG. 5 shows a top view of the apparatus of FIG. 1 in use wherein a user (not shown) is pulling on the right handle assembly 60*b*. The right handle bracket 60*b* is shown sliding across the rod 12 to the left, as previously described. The pull cable 80 extends from the right handle 90*b*, through the right handle bracket 60*b*, across a portion of the rod 12, into the left handle bracket 60*a* and ending at the left handle 90*a*. The resistance cable 31 extends from the right handle bracket 60*b* around the right front side pulley wheel 35*b*, around the right rear side pulley wheel 36*b*, around the right central pulley wheels 37*b*-38*b*, and into the central housing 23 (where it further extends around the common wheel 42, not shown) before exiting from the central housing 23 and extending over the left central pulley wheels 37*a*-38*a*, the left rear side wheel 36*a*, the left front side wheel 35*a*, and terminating at the left handle bracket 60*a*. The resistance pulley wheels are mounted in respective housings fixed to the pivot arm structure 50. The upper and lower central pulley wheels 37-38 are mounted to a transverse arm 56 extending between the side arms 52*a*, 52*b* of the pivot structure 50, with the resistance cable 31 disposed in a bore of the transverse arm 56. A pair of counterweights 55*a*, 55*b* are attached to a rear transverse arm 51 of the pivot arm structure for counterbalancing the pivot arm structure 50. A pair of diagonally disposed trusses 20*a*, 20*b* extending from the vertical support structure 22 support the transverse arm 56 and rotatable joints 156.

FIG. 5 also shows in greater detail the adjustment mechanism 160 for varying the pivot position of the arm structure 50. A user (not shown) engages a finger lever 162 at one end of an adjustment cable 163, the cable 163 extending through a central bore of the right support arm 52*b* and over a pulley wheel 165 mounted in the right end of transverse arm 56; the other end of the adjustment cable 163 is attached to a pin 168 for releasable insertion into one of the apertures 171 in the support plate 170, for selecting (fixing) the respective pivot position of the arm structure 50.

Figure 6:
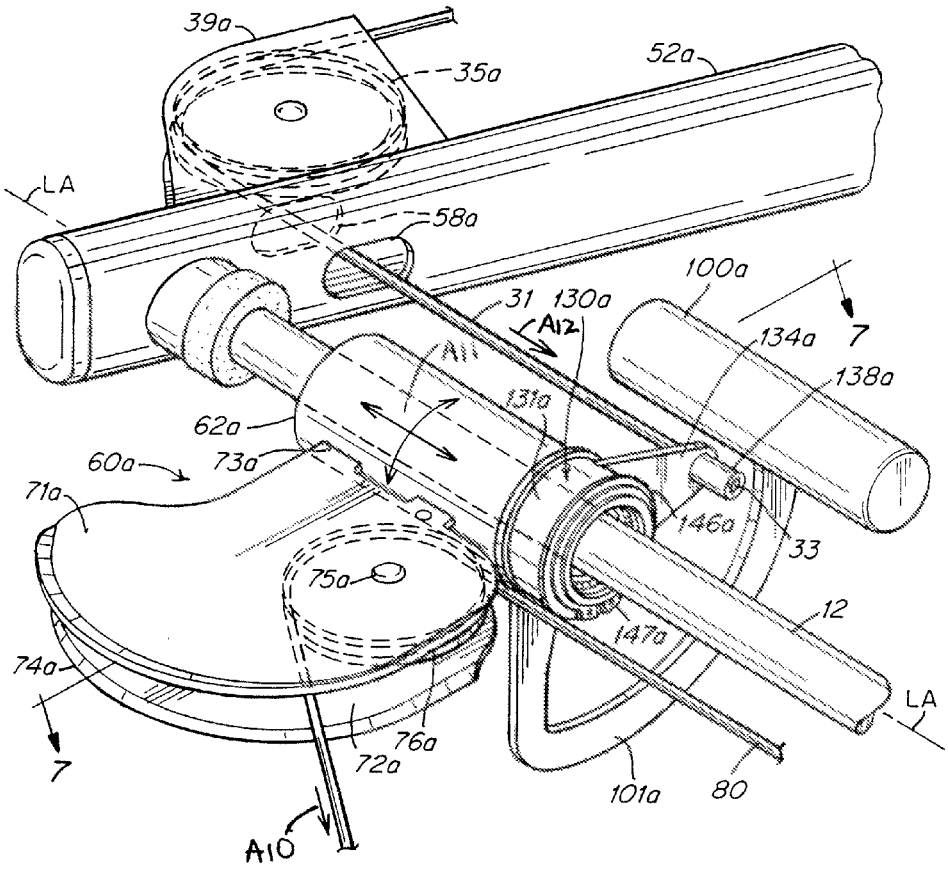
FIG. 6 is a fragmentary detailed perspective view of the left hand handle assembly in use.
Figure 7:
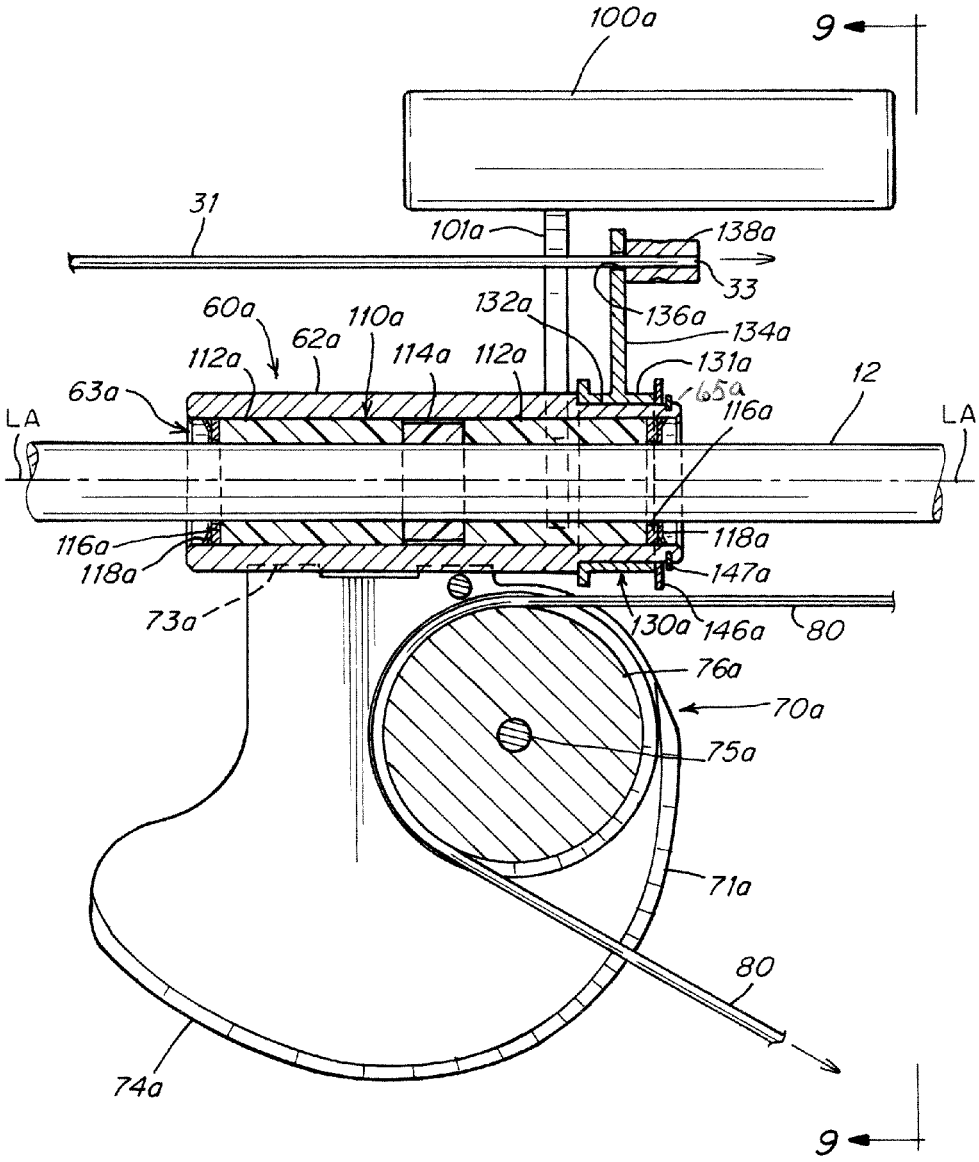
FIG. 7 is a cross-sectional plan view of the left hand handle assembly taken along line 7-7 of FIG. 6.
Figure 8:
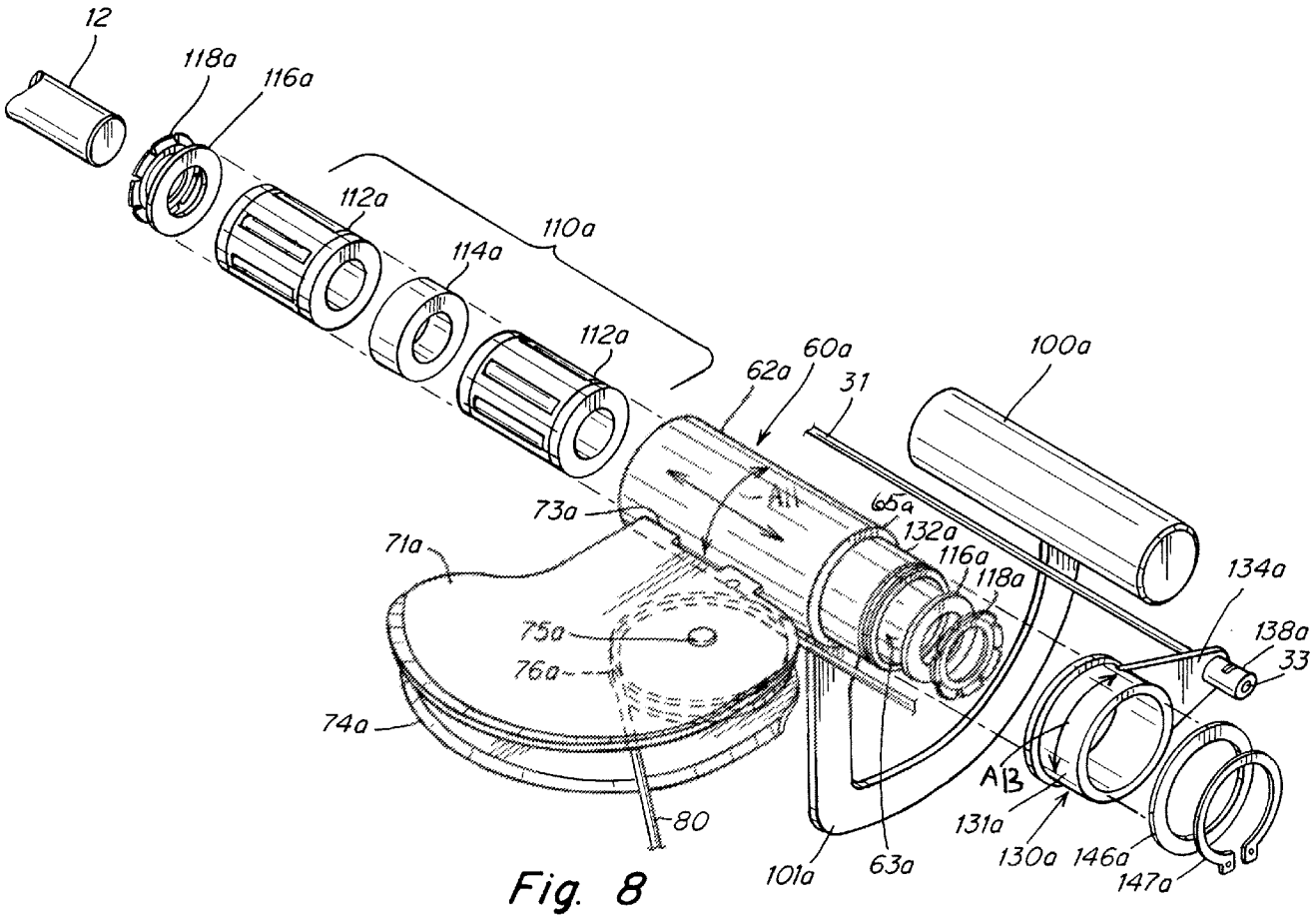
FIG. 8 is an exploded perspective view of the left hand handle assembly of FIG. 7.

FIG. 6 is a fragmentary detailed perspective view of the left handle assembly 60*a* in use. When a user (not shown) pulls on the left handle 90*a* (not shown) connected to pull cable 80 in the direction of the arrow A10, the pull cable 80 rotates about pulley wheel 76*a* and is extended further from pulley housing 71*a* of the left handle bracket 60*a*. The housing 71*a* includes two spaced apart parallel plates between which is defined a cavity 72*a* in which the pulley wheel 76*a* resides; the wheel is free to rotate in the cavity, being rotatably mounted between the opposing plates by a pin 75*a*. The housing has an open end 74*a* from which the pull cable 80 extends, and an opposing second end 73*a* attached to the slidable tube or sleeve 62*a* of the left handle bracket 60*a*. The tube or sleeve 62*a* has a central bore 63*a* which is slidable over rod 12, as shown by the arrows. The tube or sleeve 62*a* is mounted on rod 12 by a bearing assembly 110*a* which is illustrated in FIGS. 7-8. Mounted on one end of the tube 62*a* is a tabbed collar 130*a*; the collar includes a tubular collar portion 131*a* concentrically disposed over and around the tube 62*a* (or an inwardly disposed distal tubular end 132*a* of the tube 62*a*), and a transverse arm 134*a* extending radially from the collar portion 131*a* and having at its opposing end a threaded connector 138*a* that secures the first distal end 33 of resistance cable 31 to the tube 62*a*/collar 130*a*. A snap ring 147*a* and washer 146*a* secure the collar 130*a* to the end of the tube 62*a*. The collar 130*a* is freely rotatably mounted on and around the slidable tube 62*a* and bracket 60*a*. Thus, both the bracket 60*a* and the collar 130*a* are freely rotatably mounted on and around the rod 12 for free rotation around the axis LA (see arrows A11), the bracket 60*a* and collar 130*a* being independently freely rotatable around each other and the rod 12 axis LA. Also extending from tube 62*a* is a curved arm 101*a* having at its opposing end a counterweight 100*a* for counterbalancing the weight of the pulley housing 71*a*, pulley wheel 76*a* and handle 90*a*. This ensures that both pull cable 80 and resistance cable 31 lie in planes substantially parallel to rod 12 (e.g., in plane P50 in the middle position).

As previously described, the left side support arm 52*a* has, adjacent its front end, a housing 39*a* for mounting the left front pulley wheel 35*a*, and a pair of aligned apertures 58*a*, through which the resistance cable 31 extends in parallel alignment with rod 12. As a result, when a user pulls on the left handle 90*a*, the pull cable 80 extends forwardly away from the frame 11, typically in a forwardly and rightwardly direction (see arrow A10), causing the pull cable 80 to rotate counterclockwise about wheel 75*a*, pulling the sliding tube 62*a* and the attached resistance cable 31 to the right (arrow A12) along rod 12, to the extent the user's pull force can overcome the resistance set by the weight stack 150 to which the resistance cable 31 is attached.

FIG. 7 is a more detailed internal view of the left handle assembly of FIG. 6, taken along lines 7-7, showing a cross section of the slidable tube 62*a*, tabbed collar 130*a* and a bearing assembly 110*a* for mounting tube 62*a* on rod 12. As shown and described below, the handle bracket 60*a* and slidable tube 62*a* are assembled together with the collar 130*a* in a manner such that the bracket 60*a*/tube 62*a* and collar 130*a* are each rotatable independently of each other (arrow A13) for free rotation around the longitudinal axis LA of the rod 12. The bearing assembly includes a pair of left and right bearing sleeves 112*a*, 112*a* concentrically disposed about axis LA and on either side of a hollow cylindrical spacer 114*a*; together the sleeves and spacer are secured within the central bore 63*a* of tube 62*a*, enabling the tube 62*a* to slide on the outer surface of rod 12 in both the left and right directions. A bearing retainer 118*a* and washer 116*a* are provided at each opposing end of the tube 62*a* for securing the bearing assembly within the tube bore 63*a*. This same bearing assembly is further illustrated in the exploded perspective view of FIG. 8.

As further illustrated in FIGS. 7-8, the collar 130*a* includes a tubular collar portion 131*a* which is secured to the outer circumference of the tubular end 132*a* of tube 62*a* at one distal end 65*a* thereof, the collar being secured to the tube by a washer 146*a* and snap ring 147*a* such that the collar 130*a* and the bracket 60*a*/tube 62*a* are longitudinally fixedly attached to each other and forced to travel or slide longitudinally along the axis LA together with each other. Extending transverse to the collar portion 131*a* is an arm or tab 134*a* having at its free end an aperture 136*a* through which the resistance cable 31 extends, and an adjacent threaded portion 138*a* which secures the first end 33 of resistance cable 31 to the left handle bracket 60*a*. As previously described the handle bracket assembly 60*a* maintains both the pull cable 80 and resistance cable 31 in substantially parallel alignment with the rod 12 during use.

Figure 7A:
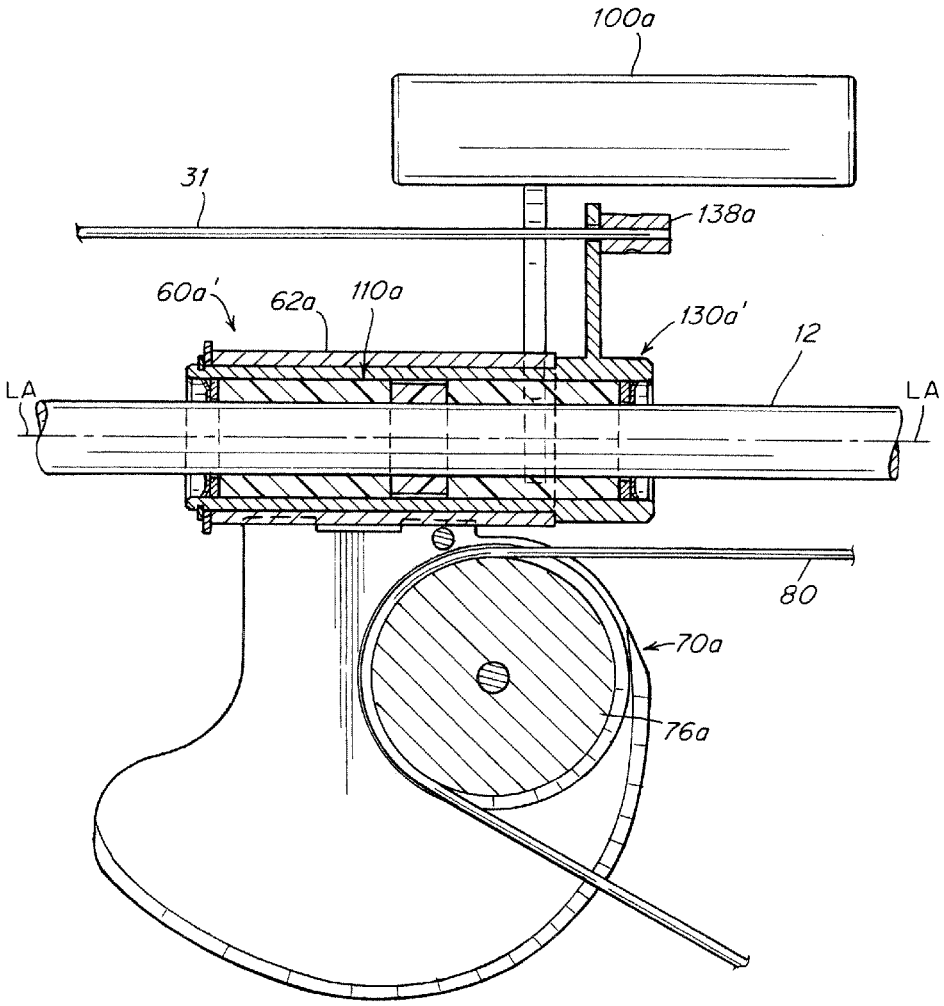
FIG. 7A is a cross-sectional view similar to FIG. 7 but showing an alternate embodiment of handle assembly.

In an alternative embodiment shown in FIG. 7A, the collar 130*a* on which the resistance cable 31 is mounted and the bracket 60*a* to which the handle pulley 76*a* is attached can alternatively be configured such that the collar 130*a* is mounted directly on the outside surface of the rod 12 via bearings that enable the collar 130*a* to rotate freely around and on the surface of the rod 12. In such an embodiment, the sleeve or bracket 60*a* is preferably rotatably mounted on an outside surface of a tubular element of the collar 130*a* such that the bracket 60*a* is rotatable independently and freely around and on the collar 130*a*.

Figure 9:
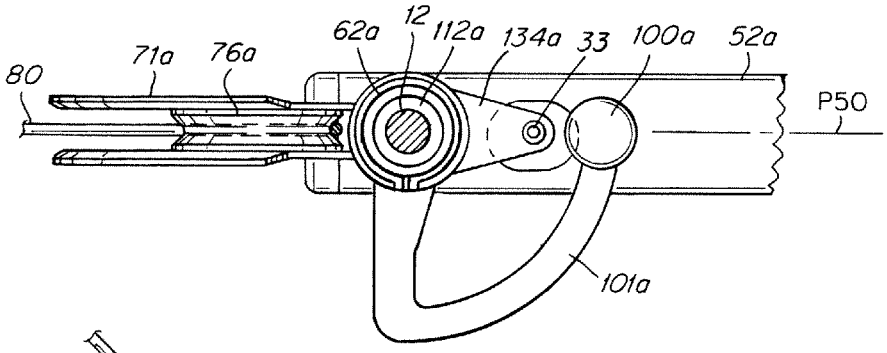
FIG. 9 is a schematic cross-sectional view of the left hand handle assembly taken along line 9-9 of FIG. 7 with the arms in a horizontal position.
Figure 10:
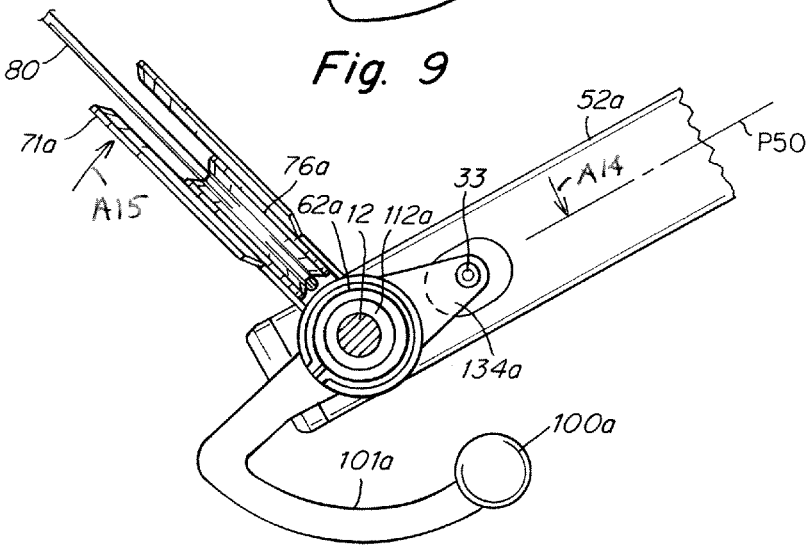
FIG. 10 is a schematic view similar to FIG. 9 but showing the support arm structure pivoted to a lowered position.
Figure 11:
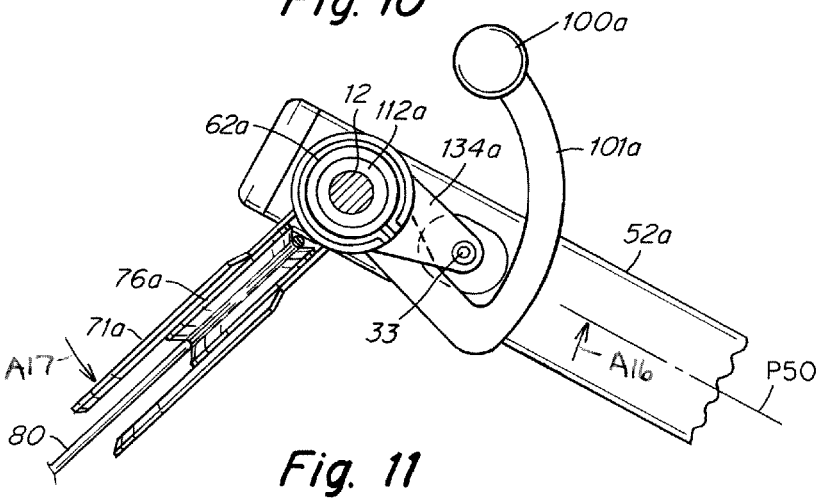
FIG. 11 is a schematic view similar to FIG. 9 but showing the support arm structure pivoted to a raised position.

FIGS. 9-11 show three schematic cross-sectional views of the left handle bracket assembly taken along line 9-9 of FIG. 7, with the left support arm 52*a* in three different positions. FIG. 9 shown the support arm 52*a* in a middle position (in horizontal plane P50). The rod 12 is shown in cross section within the bore of the bearing sleeve 112*a*; the bearing sleeve lies concentrically within the bore of tube 62*a*. The bearing sleeve and tube can rotate clockwise and counterclockwise about the rod 12. One end 33 of the resistance cable 31 is anchored to the arm 134*a* of 130*a*. The counterweight 100*a* on arm 101*a* counterbalances the bracket housing 71*a* and pulley wheel 76*a*, about which the pull cable 80 rotates.

In FIG. 10, the left support arm 52*a* has been rotated counterclockwise (see arrow A14, with respect to the position shown in FIG. 9) to a lower position, such that rod 12 now lies in a horizontal plane closer to the ground surface 2. In this position, a user will pull upwardly on pull cable 80 (see FIG. 2B). The left handle 90*a* (not shown) accommodates this upward pulling motion by pulley wheel 76*a* and pulley housing 71*a* being rotated clockwise (arrow 15) about rod 12. As a result, the counterweight 100*a* is now shown at a lower position (closer to ground plane P2), below the horizontal plane in which rod 12 resides.

Similarly, FIG. 11 shows the left support arm 52*a* rotated clockwise (arrow A16) in the opposite direction, placing rod 12 in a higher position. Now, a user pulls downwardly on pull cable 80, causing the pulley wheel 67*a* and pulley housing 71*a* to rotate counterclockwise (arrow A17) about rod 12. As a result, the counterweight 100*a* is now positioned above the horizontal plane in which rod 12 resides.

While specific embodiments of the present invention have been shown and described, it will be apparent that many modifications can be made thereto without departing from the scope of the invention. Accordingly, the invention is not limited by the foregoing description.

The invention claimed is:

1. An exercise apparatus comprising:

an elongated rod pivotably mounted on a frame, the rod having a longitudinal axis and first and second ends, the elongated rod being manually pivotable by a user to adjust position of the rod relative to the frame;

a pair of pulleys each mounted on an associated sleeve that is slidably mounted on the elongated rod;

each of the pulleys being interconnected to a force resistance mechanism and adapted to be held in a stable rest position at a respective first end and second end of the elongated rod;

the pulleys each comprising a respective pulley wheel, the pulleys being interconnected by a single pull cable having opposing ends wound around and interconnecting each pulley wheel;

each end of the pull cable being interconnected to an associated hand grip;

the interconnection between the pulleys and the force resistance mechanism being arranged such that when the user grasps a selected one of the hand grips and moves the hand grip away from the longitudinal axis, the pulley associated with the selected hand grip is slidable along the longitudinal axis of the elongated rod under forcible resistance from the force resistance mechanism.

2. The apparatus of claim 1 wherein the pulleys are interconnected to the force resistance mechanism via a connector cable.

3. The apparatus of claim 2 wherein the connector cable is interconnected to each of the sleeves on which the pulleys are mounted.

4. The apparatus of claim 3 wherein the rod is adjustably mounted to the frame via a frame member that pivots with respect to the frame.

5. The apparatus of claim 1 wherein the elongated rod is mounted to the frame such that the rod is stationary against rotation transverse to the longitudinal axis of the rod.

6. An exercise apparatus comprising:

an elongated rod mounted on a frame, the rod having a longitudinal axis and first and second ends;

a pair of pulleys each mounted on an associated sleeve that is slidably mounted on the elongated rod;

each of the pulleys being interconnected to a force resistance mechanism and adapted to be held in a stable rest position at a respective first end and second end of the elongated rod;

the pulleys each comprising a respective pulley wheel, the pulleys being interconnected by a single pull cable having opposing ends wound around and interconnecting each pulley wheels;

each end of the pull cable being interconnected to an associated hand grip;

the interconnection between the pulleys and the force resistance mechanism being arranged such that when the user grasps a selected one of the hand grips and moves the hand grip away from the longitudinal axis, the pulley associated with the selected hand grip is slidable along the longitudinal axis of the elongated rod under forcible resistance from the force resistance mechanism, wherein the ends of the elongated rod are adjustably mounted to the frame such that the longitudinal axis is adjustable to one of a plurality of fixed vertical positions of selectively variable height relative to a ground surface on which a user is disposed for performing an exercise.

7. The apparatus of claim 6 wherein the elongated rod is mounted to the frame such that the longitudinal axis of the rod is disposed generally parallel to the ground surface at all fixed vertical positions of the rod.

8. Method of performing a muscle exercise comprising providing an exercise apparatus comprised of a frame stationary with respect to a ground surface on which a user is disposed for performing an exercise, an elongated rod mounted on the frame having a longitudinal axis and first and second ends, the elongated rod being manually pivotable by a user to adjust position of the rod relative to the frame, a pair of pulleys each mounted on an associated sleeve that is slidably mounted on the elongated rod, wherein each of the pulleys is interconnected to a force resistance mechanism and wherein the pulleys are interconnected by a single pull cable having opposing ends each interconnected to an associated hand grip engageable by the user, the method further comprising:

the user grasping a selected one of the hand grips and moving the selected grip away from the longitudinal axis of the rod with a degree of force sufficient to overcome the force resistance mechanism such that the pulley and sleeve associated with the selected hand grip slides along the longitudinal axis of the elongated rod.

9. An exercise apparatus comprising:

an elongated rod mounted on a frame, the rod having a longitudinal axis and first and second ends;

a pair of pulleys each mounted on an associated sleeve that is slidably mounted on the elongated rod;

each of the pulleys being interconnected to a force resistance mechanism and adapted to be held in a stable rest position at a respective first and second ends of the elongated rod;

the pulleys each comprising a respective pulley wheel, the pulleys being interconnected by a single pull cable having opposing ends wound around and interconnecting each pulley wheel;

each end of the pull cable being interconnected to an associated hand grip;

the interconnection between the pulleys and the force resistance mechanism being arranged such that when the user grasps a selected one of the hand grips and moves the hand grip away from the longitudinal axis, the pulley associated with the selected hand grip is slidable along the longitudinal axis of the elongated rod under forcible resistance from the force resistance mechanism; and the rod being mounted on the frame such that the longitudinal axis of the rod is disposed in a generally horizontal orientation.

10. The apparatus of claim 9, wherein:

the rod is adjustably mounted to the frame on a pivot arm structure, wherein the arm structure rotates with respect to the frame for adjusting the height of the rod above a ground surface on which a user is disposed.

11. The apparatus of claim 10, further including:

a pivot adjustment mechanism including a support plate mounted on the frame with a plurality of apertures disposed in a circumferential array for adjusting the rotable position of the arm structure with respect to the frame.

12. The apparatus of claim 10, wherein:

the sleeves are each interconnected to the force resistance mechanism via a connector cable and the connector cable engages one or more pulley wheels mounted to the pivot arm structure.

13. The apparatus of claim 12, wherein:

the connector cable is assembled together with the sleeve for free rotation independent of the sleeve around the elongated rod.

14. The apparatus of claim 13, wherein:

the sleeve is mounted for rotation about the longitudinal axis of the rod.

15. An exercise apparatus comprising:

an elongated rod mounted on a frame having a longitudinal axis, the elongated rod being manually pivotable by a user to adjust position of the rod relative to the frame;

a pair of pulleys each mounted on an associated sleeve adapted to slide along the elongated rod;

a single pull cable having opposing ends wound around and interconnecting the pair of pulleys, each end of the cable being connected to an associated hand grip;

each pulley being slidable together with its associated sleeve along the elongated rod via a user grasping the associated hand grip and moving the hand grip away from the longitudinal axis; and wherein the sleeves are interconnected to a force resistance mechanism holding the sleeves at opposing ends of the elongated rod under a selected resistance force.

16. The apparatus of claim 15 wherein the hand grip is rotatable with respect to its associated sleeve.

17. The apparatus of claim 16 wherein the elongated rod is mounted on the frame such that the longitudinal axis of the rod is selectively adjustable to one of a plurality of fixed positions of selectively variable vertical distance relative to a ground surface on which the user is supported.

18. The apparatus of claim 15 wherein the sleeves are each interconnected to a force resistance mechanism via a connector cable.

19. The apparatus of claim 18 wherein the force resistance mechanism comprises a plurality of incremental force resistance elements that are selectively engagable by the user with the connector cable.

20. The apparatus of claim 18 wherein each of the sleeves are assembled together with respective collars, the sleeves being mounted together with the respective collars for free rotation around the elongated rod, the collars being interconnected to a respective opposing end of a connector cable, the collars being assembled together with the sleeves for free rotation independent of the sleeves around the elongated rod.

21. The apparatus of claim 18 wherein the connector cable has opposing ends interconnected to respective ones of the sleeves, the connector cable having a portion intermediate the opposing ends engageable with the force resistance mechanism.

22. An exercise apparatus comprising:

an elongated rod mounted on a frame having a longitudinal axis, a pair of pulleys each mounted on an associated sleeve adapted to slide along the elongated rod;

a single pull cable having opposing ends wound around and interconnecting the pair of pulleys, each end of the cable being connected to an associated hand grip;

each pulley being slidable together with its associated sleeve along the elongated rod via a user grasping the associated hand grip and moving the hand grip away from the longitudinal axis; and wherein the sleeves are interconnected to a force resistance mechanism holding the sleeves at opposing ends of the elongated rod under a selected resistance force wherein the elongated rod has a longitudinal axis, the rod being mounted on the frame such that the rod is disposed in a generally horizontal orientation.

* * * * *